US009706633B2

(12) United States Patent
Asai et al.

(10) Patent No.: US 9,706,633 B2
(45) Date of Patent: Jul. 11, 2017

(54) MAGNETIZED COAXIAL PLASMA GENERATION DEVICE

(71) Applicant: NIHON UNIVERSITY, Tokyo (JP)

(72) Inventors: Tomohiko Asai, Tokyo (JP); Jun'ichi Sekiguchi, Tokyo (JP); Tadafumi Matsumoto, Tokyo (JP)

(73) Assignee: NIHON UNIVERSITY, Tokyo (JP)

( * ) Notice: Subject to any disclaimer, the term of this patent is extended or adjusted under 35 U.S.C. 154(b) by 0 days.

(21) Appl. No.: 14/902,477

(22) PCT Filed: Jun. 30, 2014

(86) PCT No.: PCT/JP2014/067337

§ 371 (c)(1),
(2) Date: Dec. 31, 2015

(87) PCT Pub. No.: WO2015/002131

PCT Pub. Date: Jan. 8, 2015

(65) Prior Publication Data

US 2016/0374188 A1 Dec. 22, 2016

(30) Foreign Application Priority Data

Jul. 2, 2013 (JP) ..... 2013-138533

(51) Int. Cl.
*H05H 1/12* (2006.01)
*H05H 1/02* (2006.01)
(Continued)

(52) U.S. Cl.
CPC ..... *H05H 1/12* (2013.01); *H05H 1/02* (2013.01); *H05H 1/24* (2013.01); *H05H 1/46* (2013.01);
(Continued)

(58) Field of Classification Search
None
See application file for complete search history.

(56) References Cited

U.S. PATENT DOCUMENTS 5,359,258 A * 10/1994 Arkhipov ..... F03H 1/0075 313/313
5,475,354 A * 12/1995 Valentian ..... F03H 1/0075 313/359.1
(Continued)

FOREIGN PATENT DOCUMENTS

JP 63-91999 4/1988
JP 05240143 9/1993
(Continued)

OTHER PUBLICATIONS

Hooper et al "Sustained Spheromak Physics Experiment" —UCRL JC 132034.*
(Continued)

*Primary Examiner* — Douglas W Owens
*Assistant Examiner* — Srinivas Sathiraju
(74) *Attorney, Agent, or Firm* — Wells St. John P.S.

(57) ABSTRACT

Provided is a magnetized coaxial plasma generation device having increased magnetization efficiency and capable of improving power conservation and reducing the thermal load on a coil. The magnetized coaxial plasma generation device generating spheromak plasma comprises: an external electrode (1); an internal electrode (2); a plasma generation gas supply section (3); a power supply circuit (4); a bias coil (5); a pulse power supply (6) for the bias coil; a magnetic flux conservation section (7); and a control section (8). The bias coil (5) is disposed inside the internal electrode and generates a bias magnetic field between the external and internal electrodes. The pulse power supply (6) for the bias coil pulse-drives the bias coil. The magnetic flux conservation section (7) is disposed outside the external electrode.
(Continued)

The control section controls the pulse power supply for the bias coil so as to pulse-drive the bias coil for a time sufficient to apply a bias magnetic field necessary to generate the spheromak plasma between the external and internal electrodes and within a time shorter than a skin time of the magnetic flux of the bias magnetic field into the magnetic flux conservation section.

7 Claims, 4 Drawing Sheets

(51) Int. Cl.
*H05H 1/24* (2006.01)
*H05H 1/46* (2006.01)
*H05H 1/48* (2006.01)

(52) U.S. Cl.
CPC ..... *H05H 1/48* (2013.01); *H05H 2001/466* (2013.01)

(56) References Cited

U.S. PATENT DOCUMENTS 5,763,989 A * 6/1998 Kaufman ..... H05H 1/54 313/361.1
5,798,602 A * 8/1998 Gopanchuk ..... H05H 1/54 313/359.1
5,838,120 A * 11/1998 Semenkin ..... H05H 1/54 250/396 R
5,892,329 A * 4/1999 Arkhipov ..... H05H 1/54 313/362.1
7,624,566 B1 * 12/2009 Manzella ..... F03H 1/0075 60/202
8,989,343 B2 * 3/2015 Arai ..... G06T 7/0012 378/20
2008/0136309 A1 * 6/2008 Chu ..... H01J 27/146 313/361.1

FOREIGN PATENT DOCUMENTS

JP 06-151093 5/1994
JP 2006-310101 11/2006
JP 2010-050090 3/2010

OTHER PUBLICATIONS

Brown et al "Characterization of a spheromak plasma gun; The effect of refractory electrode coatings" J App Physics 69 (9) May 1, 1991.*
Delucia et al "Non Linear evolution of the resistive interchange mode in the cylindrical spheromak" Feb. 1984.*

* cited by examiner

FIG. 4A
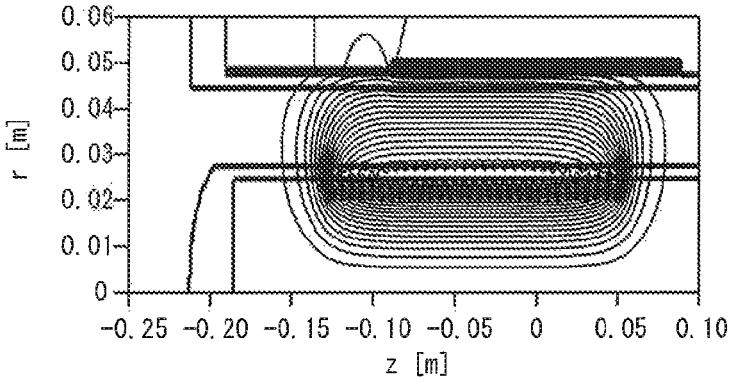
FIG. 4B
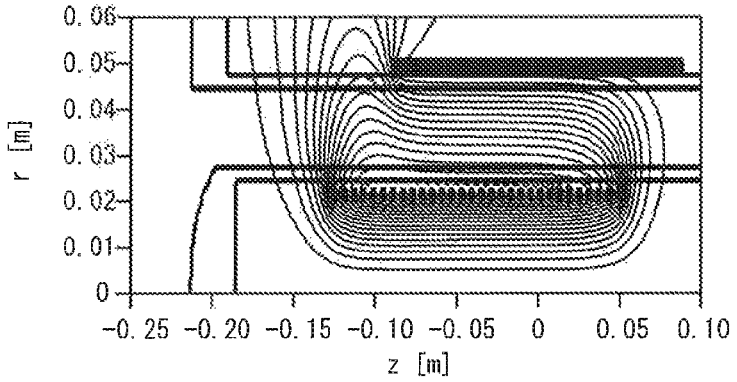
FIG. 5A
FIG. 5B
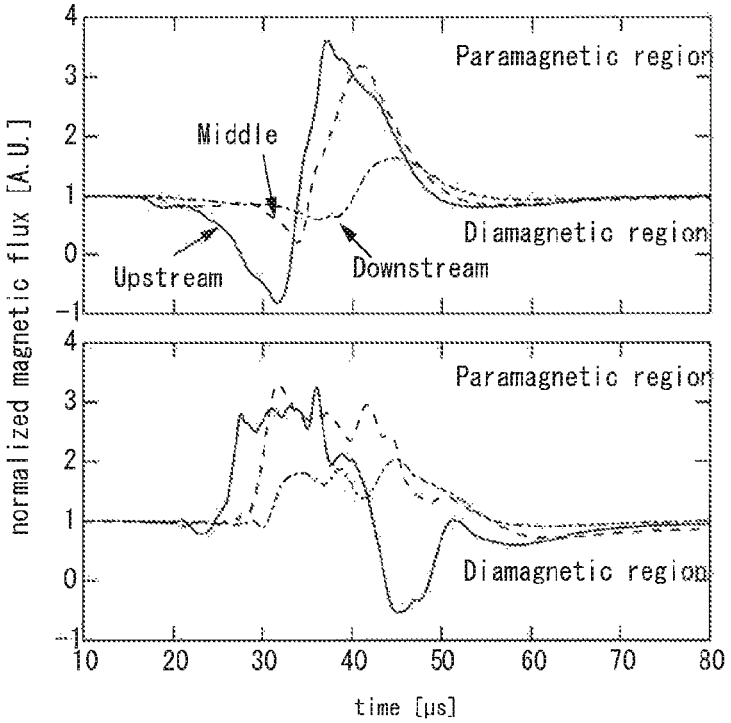

MAGNETIZED COAXIAL PLASMA GENERATION DEVICE

CROSS REFERENCE TO RELATED APPLICATION

This is a 35 U.S.C. §371 application of, and claims priority to, International Application No. PCT/JP2014/067337, which was filed on Jun. 30, 2014, and which claims priority to Japanese Patent Application No. 2013-138533, which was filed on Jul. 2, 2013, and the teachings of all the applications are incorporated herein by reference.

TECHNICAL FIELD

The present invention relates to a magnetized coaxial plasma generation device, and more particularly to a magnetized coaxial plasma generation device capable of generating spheromak plasma.

BACKGROUND ART

A magnetized coaxial plasma generation device is known as a device for generating spheromak plasma. The magnetized coaxial plasma generation device is a device that applies a voltage between coaxially disposed external and internal electrodes to generate a discharge therebetween to thereby generate plasma. When a bias magnetic field is applied to the generated plasma, the plasma is discharged while it includes the bias magnetic field together with a magnetic field generated by a discharge current, to be the spheromak plasma. The spheromak plasma has poloidal and toroidal fields each of which is a confined magnetic field generated by current flowing therein and self-organizes coordination thereof so as to preserve magnetic helicity that the magnetic structure has.

For example, Patent Document 1 discloses a magnetized coaxial plasma generation device that applies a capacitor DC discharge between external and internal electrodes and applies a bias magnetic field in a DC manner from outside the external electrode to thereby generate the spheromak plasma. Further, Patent Document 2 of which one of the present inventors is a co-inventor, discloses a magnetized coaxial plasma generation device that applies a continuous pulse signal between external and internal electrodes and applies a bias magnetic field in a DC manner from outside the external electrode.

Further, Patent Document 3 discloses a magnetized coaxial plasma generation device that applies a pulse voltage between external and internal electrodes and applies a bias magnetic field in a DC manner from inside the internal electrode to thereby generate spheromak plasma.

CITATION LIST

Patent Document

Patent Document 1: Japanese Patent Application Kokai Publication No. 2006-310101

Patent Document 2: Japanese Patent Application Kokai Publication No. 2010-050090

Patent Document 3: Japanese Patent Application Kokai Publication No. Hei 06-151093

DISCLOSURE OF THE INVENTION

Problems to be Solved by the Invention

However, the above conventional technologies have the following problem. That is, magnetic flux leakage occurs in the bias magnetic field generated by a bias coil, and a large part of the magnetic flux is distributed outside a plasma generation region, resulting in a low magnetization efficiency. Further, in some cases, the bias magnetic field is applied from outside the external electrode as disclosed in Patent Document 1 and 2. However, when the bias coil exists outside, baking of a vacuum vessel, which is essential for removing absorbed gas so as to obtain ultrahigh vacuum, cannot be carried out. That is, a coating film, etc. of a coil is affected by heat, so that the baking is carried out with the bias coil removed once, which is inefficient. Further, when the bias coil is disposed inside the internal electrode as disclosed in Patent Document 3, the problem of the baking can be eliminated; however, the above problem of the magnetic flux leakage cannot be solved with this configuration and, thus, the magnetization efficiency is not improved.

In view of the above-circumstances, the present invention is to provide a magnetized coaxial plasma generation device capable of improving magnetization efficiency, saving power, and reducing a heat load on the coil.

Means for Solving the Problems

To achieve the above object, a magnetized coaxial plasma generation device according to the present invention includes: an external electrode; an internal electrode disposed coaxially with the external electrode; a plasma generation gas supply section supplying plasma generation gas between the external and internal electrodes; a bias coil disposed inside the internal electrode and generating a bias magnetic field between the external and internal electrodes; a power supply circuit applying a load signal between the external and internal electrodes; a pulse power supply for the bias coil pulse-driving the bias coil; a magnetic flux conservation section disposed outside the external electrode and formed of a material, having high conductivity and low magnetic permeability; and a control section controlling the pulse power supply for the bias coil so as to pulse-drive the bias coil for a time sufficient to apply a bias magnetic field necessary to generate spheromak plasma between the external and internal electrodes and within a time shorter than a skin time of the magnetic flux of the bias magnetic field into the magnetic flux conservation section.

The magnetic flux conservation section may be detachably attached to the external electrode.

The magnetic conservation section may be integrally formed with the external electrode.

The magnetized coaxial plasma generation device may further include: an external, bias coil disposed outside the external electrode and generates a bias magnetic field between the external and internal electrodes; and a power supply for the external bias coil driving the external bias coil.

At least one of a speed, a shape, a temperature, a density, and a magnetic flux of generated plasma may be controlled by at least one of a thickness, a length, and an installation position of the magnetic flux conservation section.

A discharge start position of the generated plasma may be controlled by at least one of the thickness, length, and installation position of the magnetic flux conservation section.

When the magnetized coaxial plasma generation device according to the present invention is used in an alloy thin-film generation device, a position of the internal electrode at which it is ablated by the plasma may be controlled by controlling the discharge start position of the generated plasma.

Advantages of the Invention

The magnetized coaxial plasma generation device according to the present invention is capable of improving magnetization efficiency, saving power, and reducing a heat load on the coil.

BRIEF DESCRIPTION OF THE DRAWINGS

FIGS. 4A and 4B illustrate measurement results of a spatial distribution of the magnetic flux of the bias magnetic field obtained when there is a difference in configuration of a magnetic flux conservation section.

FIGS. 5A and 5B are graphs illustrating a change in a diamagnetic signal of the plasma discharged from the magnetized coaxial plasma generation device according to the present invention.

BEST MODE FOR CARRYING OUT THE INVENTION

Figure 1:
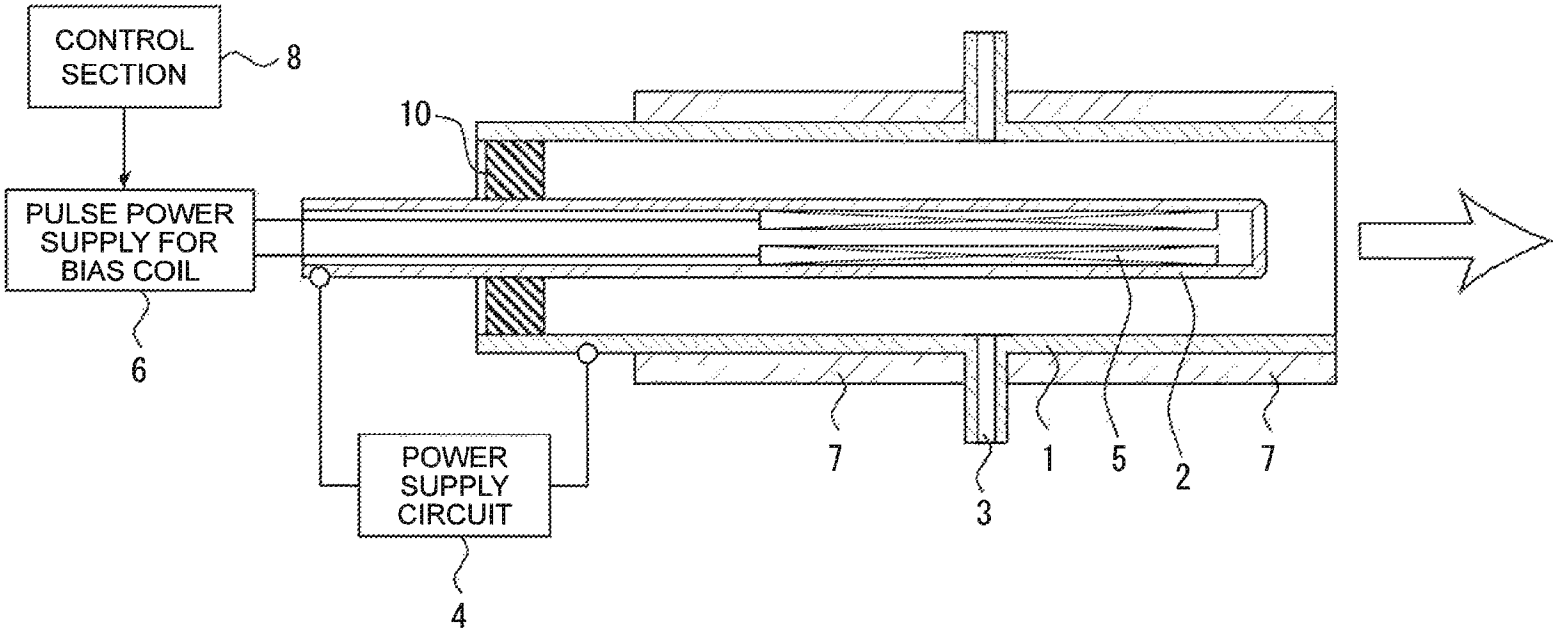
FIG. 1 is a schematic longitudinal cross-sectional view for explaining a configuration of a magnetized coaxial plasma generation device according to the present invention.

A preferred embodiment for practicing the present invention will be described with illustrated examples. FIG. 1 is a schematic longitudinal cross-sectional view for explaining a configuration of a magnetized coaxial plasma generation device according to the present invention. As illustrated, a magnetized coaxial plasma generation device according to the present invention mainly includes an external electrode 1, an internal electrode 2, a plasma generation gas supply section 3, a power supply circuit 4, a bias coil 5, a pulse power supply 6 for bias coil, a magnetic flux conservation section 7, and a control section 8.

The external electrode 1 is formed of e.g., a cylindrical conductor. The internal electrode 2 is disposed coaxially with the external electrode 1. The plasma generation gas supply section 3 is configured to supply plasma generation gas between the external electrode 1 and the internal electrode 2. The bias coil 5 generates a bias magnetic field between the external electrode 1 and the internal electrode 2. The power supply circuit 4 applies a load signal between the external electrode 1 and the internal electrode 2. The load signal means a load voltage applied between the external electrode 1 and the internal electrode 2 or a load current flowing at that time. The pulse power supply 6 for bias coil pulse-drives the bias coil 5. The magnetic flux conservation section 7 is disposed outside the external electrode 1. The control section 8 controls the pulse power supply for the bias coil so as to pulse-drive the bias coil 5. The above sections will hereinafter be described in more detail.

In the illustrated magnetized coaxial plasma generation device, the external electrode 1 and the internal electrode 2 are fixed in position while being insulated from each other at one ends thereof by an insulating member 10. The other ends of the external and internal electrodes 1 and 2 are open ends from which plasma is discharged. Preferably, the external and internal electrodes 1 and 2 are preferably configured not to be magnetized, have a high melting point, and easy to be processed. For example, they may be formed of a stainless steel. The external electrode 1 and the plasma generation gas supply section 3 are integrally formed with each other, and the plasma generation gas, such as helium gas or argon gas is supplied to a space between the external and internal electrodes 1 and 2 from the plasma generation gas supply section 3. Although the plasma generation gas supply section 3 is provided in the external electrode 1 in the illustrated example, the present invention is not limited to this. The plasma generation gas supply section may be provided in, e.g., the internal electrode 2 if the plasma generation gas can be supplied to between the external and internal electrodes 1 and 2. When the plasma generation gas is supplied to a center part of the bias coil 5 as illustrated, a magnetic flux included in plasmoid is increased most effectively. In this case, the plasma generation gas supply section 3 may be provided so as to penetrate a part of the magnetic flux conservation section 7, as illustrated.

The power supply circuit 4 applies a load signal between the external and internal electrodes 1 and 2. The power supply circuit 4 may apply the load signal in a DC manner, or may apply a continuous pulse signal as in Patent Document 2.

A basic configuration of the magnetized coaxial plasma generation device according to this invention is not especially limited to the illustrated configuration, and the magnetized coaxial plasma generation device may have any configuration as long as it can generate spheromak plasma.

The bias coil 5 of the magnetized coaxial plasma generation device according to the present invention is disposed inside the internal electrode 2, This allows baking of a vacuum vessel, which is essential for obtaining ultrahigh vacuum to be carried out without being affected by the bias coil. This makes it possible to remove absorbed gas. The bias coil 5 applies a bias magnetic field to the plasma generated between the external and internal electrodes 1 and 2. This causes the plasma to be discharged while it includes a magnetic field generated by a discharge current and the bias magnetic field, resulting in generation of the spheromak plasma.

The following describes the most characteristic constituents of the present invention. As described above, the pulse power supply 6 for the bias coil pulse-drives the bias coil 5. The pulse power supply 6 for bias coil is configured to be able to apply, e.g., a sine-wave current having a predetermined frequency. Further, it is possible to apply a rectangular-wave continuous pulse signal to the bias coil 5 by inverter-controlling power supply (capacitor) using a transistor.

The magnetic flux conservation section 7 is disposed outside the external electrode 1. The magnetic flux conservation section 7 is formed of a material having high conductivity and low magnetic permeability. For example, the magnetic flux conservation section 7 may be formed of copper or a copper alloy. The magnetic flux conservation section 7 is used for preventing the magnetic flux of the bias magnetic field applied by the bias coil 5 from leaking outside. The magnetic flux conservation section 7 is formed so as to match with an outer shape of the external electrode 1. For example, when the external, electrode 1 has a cylindrical shape, the magnetic flux conservation section 7 is also formed into a cylindrical shape correspondingly. The magnetic flux conservation section 7 may be configured to cover substantially the entire external electrode 1 in a jacket-like manner or a shell-like manner. When the magnetic flux conservation section 7 has a length equal to or more than a length of the bias coil, it is possible to effectively confine the magnetic flux of the bias magnetic field generated from the bias coil 5. A thickness of the magnetic flux conservation section 7 will be described later.

The control section 8 controls the pulse power supply 6 for the bias coil so as to pulse-drive the bias coil 5 for a time sufficient to apply a bias magnetic field necessary to generate the spheromak plasma between the external and internal electrodes 1 and 2 and within a time shorter than a skin time of the magnetic flux of the bias magnetic field into the magnetic flux conservation section 7. That is, the control section 8 may control a spatial distribution of the magnetic flux of the bias magnetic field at time intervals in which the magnetic flux does not soak into the magnetic flux conservation section 7 so as to effectively generate a necessary bias magnetic field between the external and internal electrodes 1 and 2.

Further, the magnetic flux conservation section 7 may have a thickness with which the magnetic flux does not soak into and penetrate through the magnetic flux conservation section 7 even when the bias coil 5 is driven for a time sufficient to apply a bias magnetic field necessary to generate the spheromak plasma between the external and internal electrodes 1 and 2. When the magnetic flux is applied to the magnetic flux conservation section 7 for a long time, it soaks into and penetrates through the magnetic flux conservation section 7, so that the pulse drive time, which is longer than the required application time of the bias magnetic field, is set in consideration of the skin time of the magnetic flux, and the thickness of the magnetic flux conservation section 7.

Further, the magnetic flux conservation section 7 may be detachably attached to the external electrode 1. This allows the thickness of the magnetic flux conservation section 7 to be changed according to a plasma generation condition, etc., thereby enhancing versatility. Further, the magnetic flux conservation section 7 may be integrally formed with the external electrode 1. That is, the external electrode 1 may be formed of a material having high conductivity and low magnetic permeability and be designed to have a thickness sufficient to allow a required application time of a bias magnetic field and a time shorter than a skin time of the magnetic flux of the bias magnetic field into the magnetic flux conservation section.

Specifically, the magnetized coaxial plasma generation device according to the present invention is designed as follows. Outer and inner diameters of the external electrode is 92 mm and 86 mm, respectively, and outer and inner diameters of the internal conductor is 54 mm and 48 mm, respectively. An inner diameter of the bias coil is 45 mm, the number of turns thereof is 50, and a coil length thereof is about 20 cm. The magnetic flux conservation section is formed of copper and has an inner diameter of 92 mm and a thickness of 3 mm. The pulse power supply for the bias coil is used to make a sine-wave current of a 1 kHz frequency in the bias coil. Such conditions allow application of a bias magnetic field sufficient to generate the spheromak plasma even within a time shorter than a skin time of the magnetic flux of the bias magnetic field into the magnetic flux conservation section.

Figure 2A:
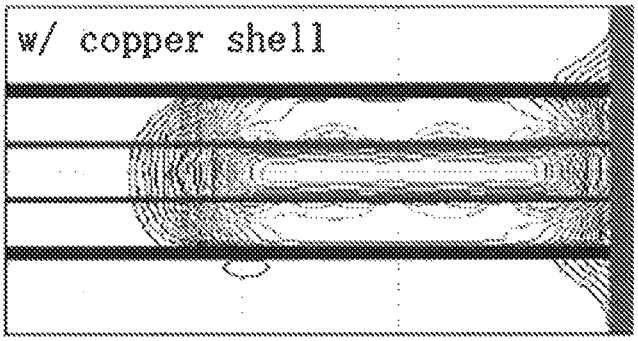
FIGS. 2A and 2B each illustrate a simulation result of a spatial distribution of a magnetic flux of a bias magnetic field in the magnetized coaxial plasma generation device according to the present invention.
Figure 2B:
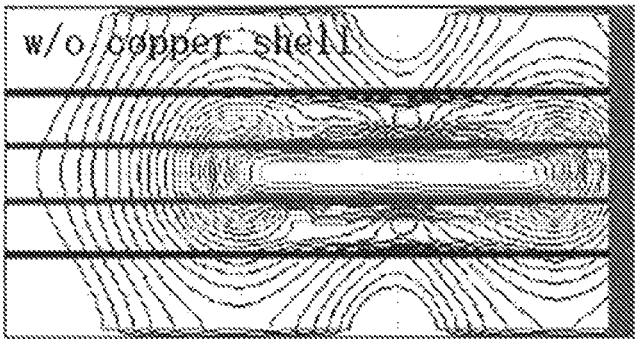

FIGS. 2A and 2B each illustrate a simulation result of a spatial distribution of the magnetic flux of the bias magnetic field in the magnetized coaxial plasma generation device according to the present invention. FIG. 2A illustrates a simulation result in a case where the magnetic flux conservation section is provided, and FIG. 2B illustrates a simulation result in a conventional approach in which a case where the magnetic flux conservation section is not provided. In this simulation, the magnetic flux conservation section is formed of copper. It can be understood from FIG. 2A that, in the magnetized coaxial plasma generation device according to the present invention, the magnetic flux of the bias magnetic field is confined between the external and internal conductors by the magnetic flux conservation section. That is, magnetization efficiency is improved.

In the thus configured magnetized coaxial plasma generation device according to the present invention, the plasma is generated as follows. First, the plasma generation gas is supplied from the plasma generation gas supply section 3. When a load signal is applied to a space between the external and internal electrodes 1 and 2 by the power supply circuit 4, a discharge is generated between the external and internal electrodes 1 and 2 to cause a discharge current to flow, with the result that plasma is generated. Then, the bias magnetic field generated by the bias coil 5 is subjected to spatial distribution control by the pulse power supply 6 for the bias coil, the magnetic flux conservation section 7, and the control section 8, and the magnetic flux is distributed in a plasma generation region. The generated plasma includes a magnetic field generated by the discharge current and the bias magnetic field generated by the bias coil 5, whereby a magnetic field in poloidal and toroidal directions is generated therein, and the resultant plasma is discharged from the open ends of the external and internal electrodes 1 and 2 as the spheromak plasma. The discharged spheromak plasma is not dispersed immediately, but discharged at high speed in a plasmoid state.

In the magnetized coaxial plasma generation device according to the present invention, it is possible to reduce leakage of the magnetic flux to the outside, thereby improving magnetization efficiency. That is, it is possible to reduce power necessary to generate the same amount of magnetic field, thereby saving power. Further, improvement in the magnetization efficiency allows reduction in size of the bias coil, thus making it possible to reduce the device in size and weight. Further, use of the pulse drive allows reduction in heat load of the bias coil.

Figure 3:
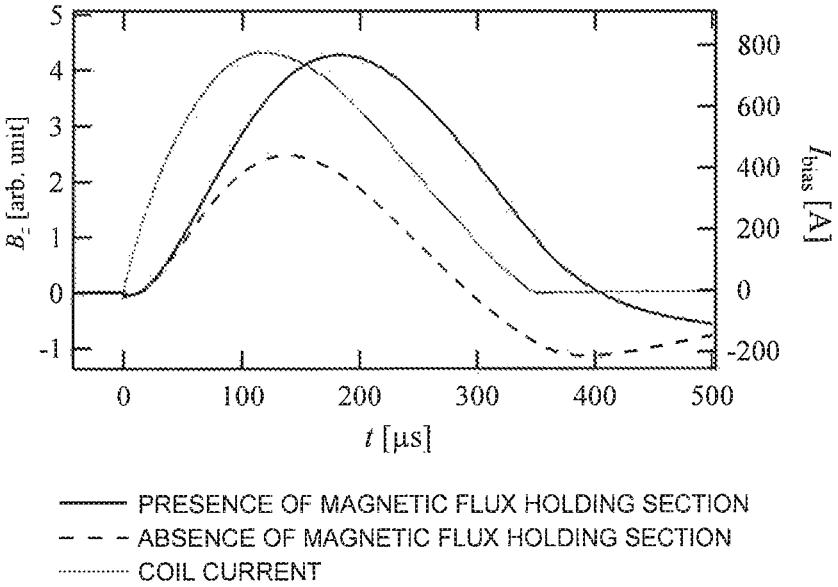
FIG. 3 illustrates a measurement result of an axial direction magnetic flux density of the bias magnetic field in the magnetized coaxial plasma generation device according to the present invention.

The following describes a measurement result of the thus configured magnetized coaxial plasma generation device according to the present invention. FIG. 3 illustrates a measurement result of an axial direction magnetic flux density of the bias magnetic field in the magnetized coaxial plasma generation device according to the present invention. In the drawing, a horizontal axis indicates a time, and a left vertical axis indicates the axial direction magnetic flux density, A fine dotted curve indicates a current change (right vertical axis) of the pulse power supply for bias coil, and a continuous curve indicates a change in the magnetic flux density in the magnetized coaxial plasma generation device according to the present invention. Further, as a comparative example, a dashed curve indicates a change in the magnetic flux density in a case where the magnetic flux conservation section is not provided.

It can be understood from the drawing that, in the magnetized coaxial plasma generation device according to the present invention, the axial direction magnetic flux density is changed corresponding to a current change of the pulse power supply for bias coil and that it has a large peak value. On the other hand, in the case where the magnetic flux conservation section 7 is not provided, the magnetic flux is only 70% relative to that in the present invention. Thus, it can be understood that the magnetic flux conservation section of the magnetized coaxial plasma generation device according to the present invention functions to allow the magnetic flux to be sufficiently held.

Further, the magnetic flux conservation section 7 of the magnetized coaxial plasma generation device according to the present invention has the following advantage. A discharge condition between the external and internal electrodes differs depending on presence/absence of the magnetic flux conservation section. That is, a discharge is generated between the external and internal electrodes for generation of the plasma by applying a current to a space between the electrodes using the power supply circuit. In this case, installation of the magnetic flux conservation section allows the discharge to be generated at a lower applied voltage. For example, in the absence of the magnetic flux conservation section, it is necessary to generate the plasma by applying a voltage of 260 V or more between the electrodes; on the other hand, in the presence of the magnetic flux conservation section, the plasma can be generated by applying a voltage of 200 V or more. Thus, for example, it is possible to generate the plasma at a lower voltage.

The following describes a measurement result of the special distribution of the flux of the bias magnetic field. FIGS. 4A and 4B illustrate measurement results of the spatial distribution of the magnetic flux of the bias magnetic field obtained when there is a difference in configuration of the magnetic flux conservation section. FIG. 4A illustrates a case where the magnetic flux conservation section is formed up to near the open end from which the plasma is discharged, and FIG. 4B illustrates a case where the magnetic flux conservation section is not formed up to near the open end from which the plasma is discharged. A vertical axis indicates a distance from a center of the internal electrode. That is, 0 is the center of the internal electrode. A horizontal axis indicates an axial direction distance, and 0 is an origin of axial direction. More specifically, the thickness of the magnetic flux conservation section is set to 3 mm and, in the example of FIG. 4A, the thickness of the magnetic flux conservation section around the open end is set to 1 mm. That is, the examples of FIGS. 4A and 4B differ in whether or not the magnetic flux conservation section of a 1 mm thickness is provided near the open end. FIGS. 5A and 5B are graphs illustrating a change in a diamagnetic signal of the plasma discharged from the magnetized coaxial plasma generation device according to the present invention. FIG. 5A corresponds to a state illustrated in FIG. 4A, and FIG. 5B corresponds to a state illustrated in FIG. 4B. In these graphs, a horizontal axis indicates a time, and a vertical axis indicates a diamagnetic signal intensity. Further, "Upstream" indicates a measurement result Obtained at a position near the open end from which the plasma is discharged, "Downstream" indicates a measurement result obtained at a position distanced from the open end, and "Middle" indicates a measurement result obtained at a position between the positions at which the "Upstream" and "Downstream" are obtained.

It can be understood from FIGS. 4A and 4B, there occurs a difference in the spatial distribution of the magnetic flux depending on whether or not the magnetic flux conservation section is formed near the open end. That is, the magnetic flux leakage from the magnetic flux conservation section having the 3 mm thickness is not found. On the other hand, the magnetic flux partially leaks from the magnetic flux conservation section of the 1 mm thickness. Further, it can be understood from FIGS. 5A and 5B, there occurs a difference in characteristics of the discharged plasma. That is, by changing the thickness or position of the magnetic flux conservation section, it is possible to make the discharged plasma pass at high speed as a plasmoid or pass at low speed as an elongated plasmoid. As described above, in the magnetized coaxial plasma generation device according to the present invention, it is possible to positively control the characteristics of the generated plasma. Specifically, changing a thickness, a length, an installation position, etc. of the magnetic flux conservation section allows a speed, a shape, a temperature, a density, a magnetic flux, etc. of the generated plasma. Further, in the magnetized coaxial plasma generation device according to the present invention, the magnetic flux conservation section is configured to be easily attached and detached, so that it is possible to facilitate selection of a type of the magnetic flux conservation section according to a usage of the generated plasma. Further, the installation position, length, etc. of the magnetic flux conservation section can be actively and arbitrarily changed, allowing active control of the plasma.

Further, changing the position, etc. of the magnetic flux conservation section allows control of a discharge start position of the generated plasma. When the discharge start position can be arbitrarily controlled, the present invention can be applied to an alloy thin-film generation device, as described below. In the alloy thin-film generation device, the internal electrode is selectively combined with a plurality of metal pieces formed respectively of various metals which are raw materials of an alloy thin-film to be generated to be formed in a rod-like shape. More specifically, a configuration of, e.g., a device disclosed in Japanese Patent Application Kokai Publication No. 2014-051699 of which one of the present inventors is a co-inventor may be employed. Then, a base plate on which the alloy thin-film is generated is disposed vertically opposite to an axial direction of the internal conductor. At this time, a position of the internal electrode at which it is ablated by the plasma is controlled by changing the discharge start position, whereby it is possible to control a mixing ratio of various metals of the alloy thin-film to be generated. That is, the thickness, length, installation position, etc., of the magnetic flux conservation section 7 may be changed so as to obtain a desired alloy thin-film.

Figure 6:
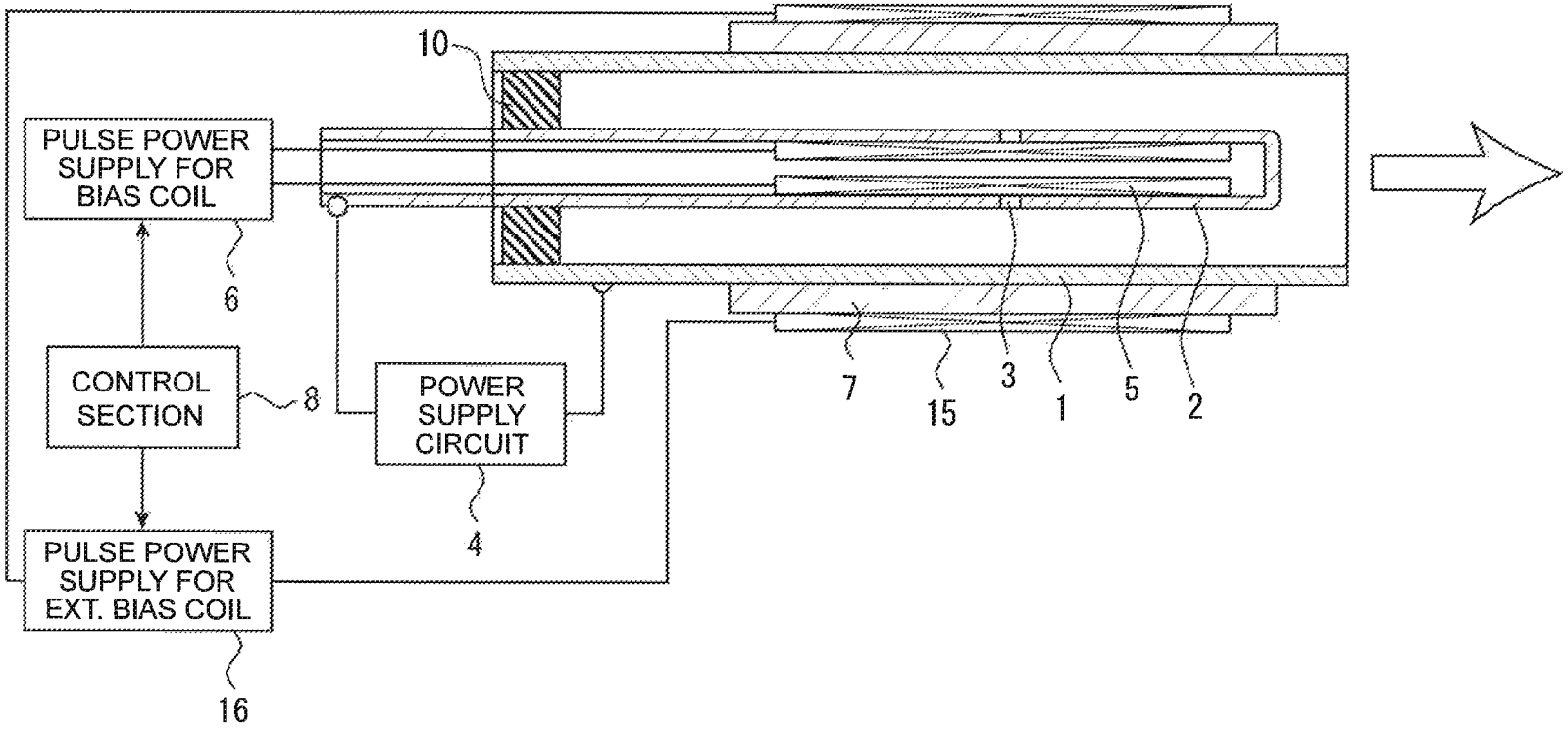
FIG. 6 is a schematic longitudinal cross-sectional view for explaining another configuration of the magnetized coaxial plasma generation device according to the present invention.

Further, in the magnetized coaxial plasma generation device thus illustrated, the bias coil that generates the bias magnetic field is disposed inside the internal electrode; however, the present invention is not limited this. FIG. 6 is a schematic longitudinal cross-sectional view for explaining another configuration of the magnetized coaxial plasma generation device according to the present invention. In the drawing, the same reference numerals as those in FIG. 1 denote the same parts as those in FIG. 1, and detailed description will be omitted. In the illustrated example, the plasma generation gas supply section 3 is provided at the inner electrode side. As illustrated, an external bias coil 15 may be additionally provided outside the external electrode 1 so as to generate a bias magnetic field between the external and internal electrodes 1 and 2. In addition, a power supply 16 for external bias coil is used to drive the external bias coil 15. In this case, the control section 8 controls also the power supply 16 for the external bias coil. The control section 8 may control the power supply 16 for the external bias coil such that the bias magnetic field is made to pass through the magnetic flux conservation section 7 to be effectively generated between the external and internal electrodes 1 and 2. That is, the control section 8 may control the spatial distribution of the magnetic flux of the bias magnetic field at time intervals in which the magnetic flux soaks into the magnetic flux conservation section 7 and penetrates therethrough. As a result, it is possible to generate the bias magnetic field by using both the bias coil inside the internal electrode 2 and the external bias coil 15 outside the external electrode 1, whereby a greater magnetic flux can be applied.

The magnetized coaxial plasma generation device according to the present invention is not limited to the above illustrated examples, but various modifications may be made without departing from the scope of the present invention.

REFERENCE SIGNS LIST

1: External electrode
2 Internal electrode
3: Plasma generation gas supply section
4: Power supply circuit
5: Bias coil
6: Pulse power supply for bias coil
7: Magnetic flux conservation section
8: Control section
10: Insulating member
15: External bias coil
16: Pulse power supply for external bias coil

The invention claimed is:

1. A magnetized coaxial plasma generation device generating spheromak plasma, the magnetized coaxial plasma generation device comprising:

an external electrode;

an internal electrode disposed coaxially with the external electrode;

a plasma generation gas supply section supplying plasma generation gas between the external and internal electrodes;

a bias coil disposed inside the internal electrode and generating a bias magnetic field between the external and internal electrodes;

a power supply circuit applying a load signal between the external and internal electrodes;

a pulse power supply for the bias coil pulse-driving the bias coil;

a magnetic flux conservation section disposed outside the external electrode and formed of a material having high conductivity and low magnetic permeability; and a control section controlling the pulse power supply for the bias coil so as to pulse-drive the bias coil for a time sufficient to apply a bias magnetic field necessary to generate the spheromak plasma between the external and internal electrodes and within a time shorter than a skin time of the magnetic flux of the bias magnetic field into the magnetic flux conservation section so as to prevent the magnetic flux soaking into and penetrating through the magnetic flux conservation section.

2. The magnetized coaxial plasma generation device according to claim 1, wherein the magnetic flux conservation section is detachably attached to the external electrode.

3. The magnetized coaxial plasma generation device according to claim 1, wherein the magnetic conservation section is integrally formed with the external electrode.

4. The magnetized coaxial plasma generation device according to claim 1, which further comprises:

an external bias coil disposed outside the external electrode and generating a bias magnetic field between the external and internal electrodes; and a power supply for the external bias coil driving the external bias coil.

5. The magnetized coaxial plasma generation device according to claim 1, wherein at least one of a speed, a shape, a temperature, a density, and a magnetic flux of generated plasma is controlled by at least one of a thickness, a length, and an installation position of the magnetic flux conservation section.

6. The magnetized coaxial plasma generation device according to claim 1, wherein a discharge start position of the generated plasma is controlled by at least one of the thickness, length, and installation position of the magnetic flux conservation section.

7. The magnetized coaxial plasma generation device according to claim 6, wherein a position of the internal electrode at which it is ablated by the plasma is controlled by controlling the discharge start position of the generated plasma when the magnetized coaxial plasma generation device is used in an alloy thin-film generation device.

* * * * *